US005127174A

United States Patent [19]

Takeshita

[11] Patent Number: 5,127,174

[45] Date of Patent: Jul. 7, 1992

[54] BLOWER DEVICE FOR SNOW THROWER

[75] Inventor: Masatoshi Takeshita, Iwata

[73] Assignee: Yamaha Hatsudoki Kabushiki Kaisha, Iwata, Japan

[21] Appl. No.: 326,969

[22] Filed: Mar. 22, 1989

[30] Foreign Application Priority Data

Mar. 23, 1988 [JP] Japan ..... 63-67196

[51] Int. Cl.[5] ..... E01H 5/06

[52] U.S. Cl. ..... 37/250; 37/256; 37/259

[58] Field of Search ..... 37/244, 248, 249, 251, 37/259, 250, 252, 253, 254, 255, 256, 257, 258, 260, 261, 262

[56] References Cited

U.S. PATENT DOCUMENTS

| | | | |
|---|---|---|---|
| 1,587,449 | 6/1926 | Wandscheer | 37/250 |
| 1,834,176 | 12/1931 | Peterson et al. | 37/248 |
| 2,075,580 | 3/1937 | Jeswine et al. | 37/260 X |
| 2,152,860 | 4/1939 | Behrens et al. | 37/248 |
| 2,179,713 | 11/1939 | Chase | 37/250 |
| 2,190,325 | 2/1940 | Bemis et al. | 37/259 |
| 2,278,220 | 3/1942 | Sicard | 37/250 |
| 2,353,928 | 7/1944 | Piltz | 37/248 |
| 2,619,746 | 12/1952 | Heaman | 37/251 |
| 2,638,691 | 5/1953 | Wallack | 37/248 |
| 2,692,445 | 10/1954 | Darnell | 37/253 X |
| 3,115,714 | 12/1963 | Johann | 37/251 X |
| 3,371,434 | 3/1968 | Wandscheer | 37/256 |
| 3,556,605 | 1/1971 | Berg et al. | 198/642 |
| 4,783,915 | 11/1988 | Sasaki et al. | 37/251 |

FOREIGN PATENT DOCUMENTS

| | | | |
|---|---|---|---|
| 1276738 | 12/1986 | U.S.S.R. | 37/250 |

OTHER PUBLICATIONS

Machine Design, "Snow Rides Jet Air Stream", pp. 152-153, Mar. 13, 1961.

*Primary Examiner*—Randolph A. Reese
*Assistant Examiner*—Arlen L. Olsen
*Attorney, Agent, or Firm*—Ernest A. Beutler

[57] ABSTRACT

An improved snow thrower and specifically an improved blower therefor that improves efficiency and reduces the likelihood of snow accumulation. The blower casing is connected to the auger housing by an exit opening that is disposed and sized so that snow blown by the blower will not reenter the auger housing. The peripheral edge of the blower casing is curved so as to reduce the likelihood of snow accumulation.

7 Claims, 6 Drawing Sheets

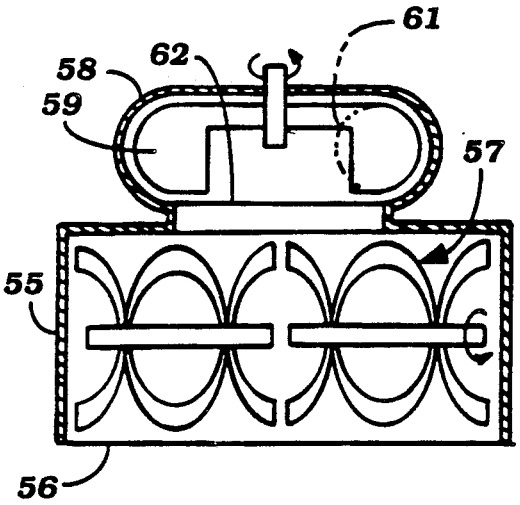
Figure 6
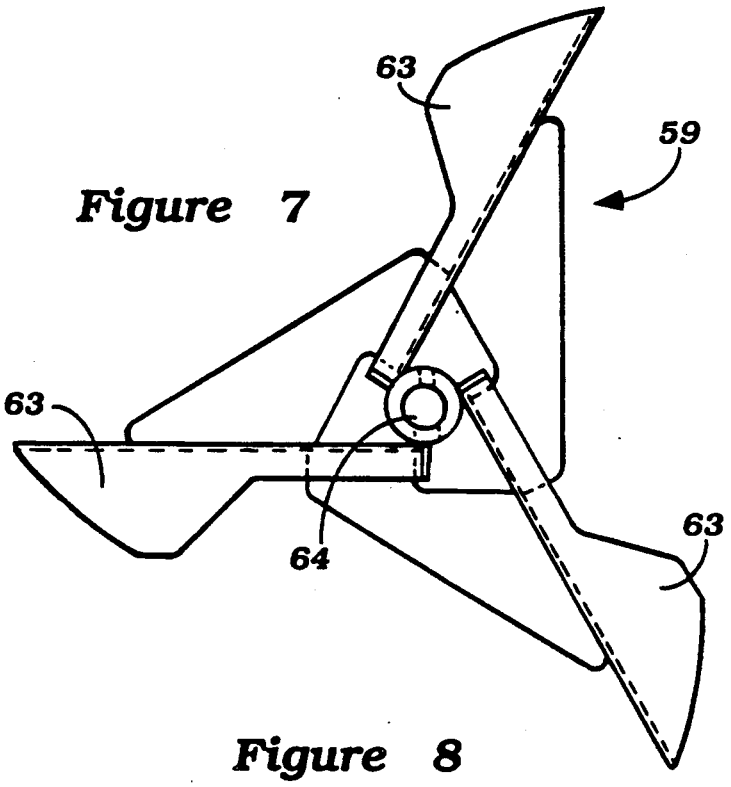
Figure 7
Figure 8
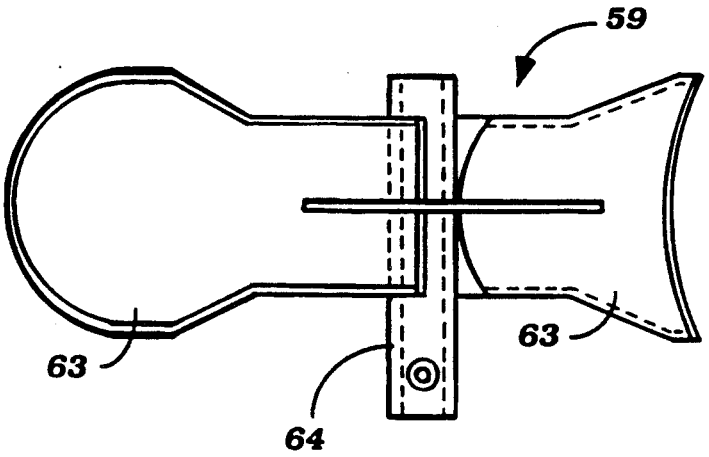

Figure 9
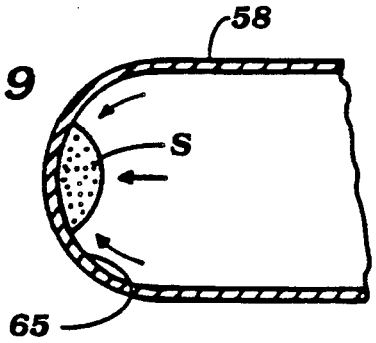
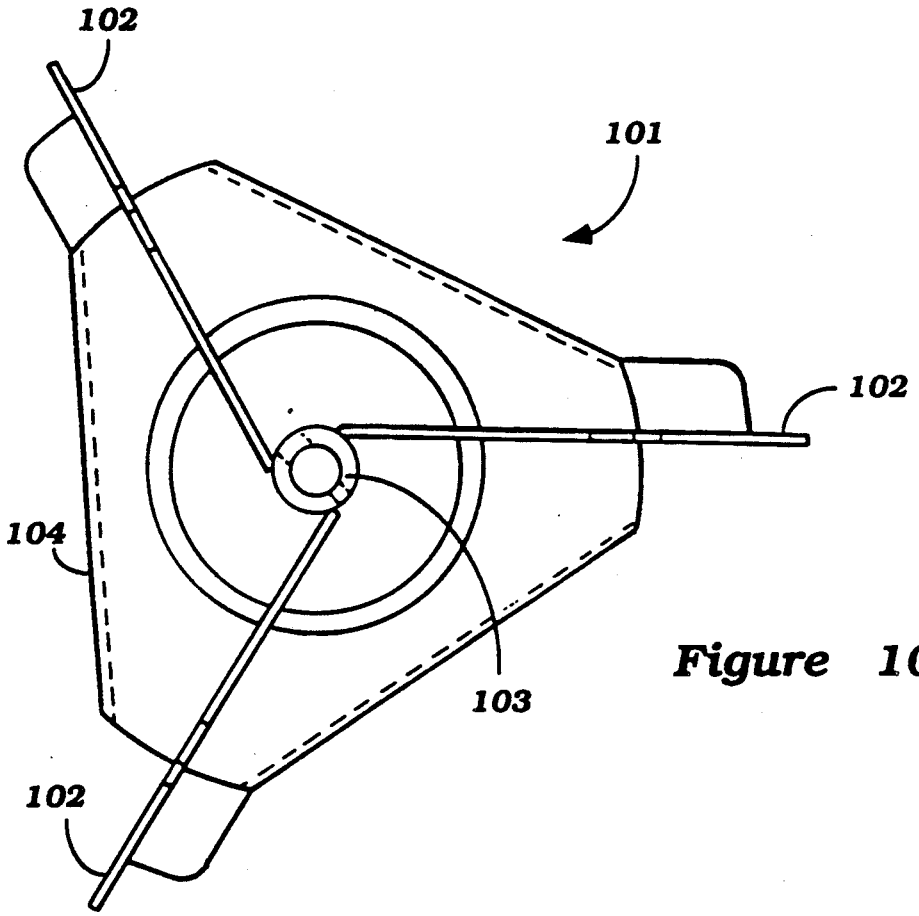
Figure 10
Figure 11
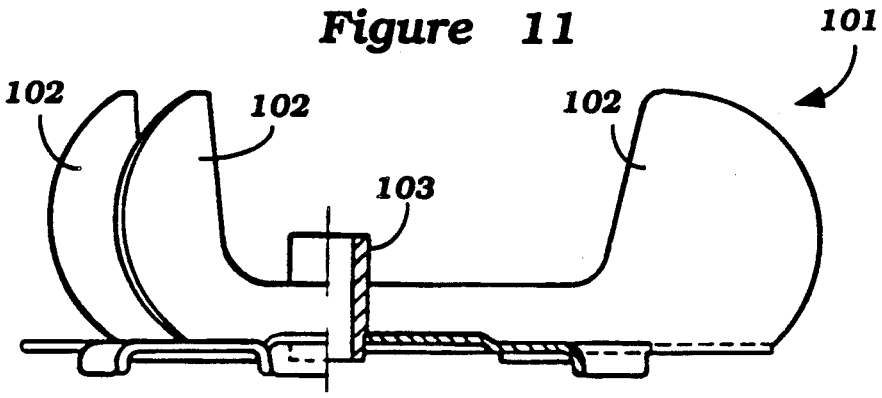

BLOWER DEVICE FOR SNOW THROWER

BACKGROUND OF THE INVENTION

This invention relates to a blower device for a snow thrower and more particularly to an improved blower arrangement that improves the efficiency of the snow thrower and which reduces the likelihood of excess snow becoming clogged in the blower casing.

One popular form of snow blower employes an auger housing that is open at the front and in which an auger rotates about a generally horizontally disposed axis. The function of the auger is to collect snow from the ground and to transfer it to a discharge area. There is further provided a blower casing behind the auger housing in which a blower rotates about an axis that is disposed generally transversely to the axis of the and which throws the snow collected from the blower through a discharge chute. In connection with these arrangements, the blower casing generally has a rectangular cross-sectional view in planes containing the axis of the blower rotation and an opening communicates this casing with the auger housing which opening is substantially coxetensive with the height of the blower casing. FIGS. 1 through 3 show a conventional prior art construction of this type.

Referring specifically to FIGS. 1 through 3, a snow blower, indicated generally by the reference numeral 11 is comprised of a main driving portion 12 that is driven along the ground in a suitable manner as by a drive belt 13 powered by an internal combustion engine of any known type. A handlebar assembly 14 is incorporated for control of the snow blower 11.

Positioned at the front of the snow blower 11 is an auger housing 15 in which an auger 16 is rotatably journaled about horizontally extending axis. It should be noted that the front of the auger housing 15 provides a forwardly facing opening 17 in which snow can be collected by the auger and delivered to a central portion therein.

This central portion is connected by means of an exit opening 18 with the interior of a blower casing 19. A blower 21 journaled for rotation within the blower casing 19 and is driven, like the auger 16 from the powering engine of the snow blower 11 in a suitable manner. The snow collected and thrown by the blower 21 is discharged through a discharge chute 22.

As may be seen, particularly by reference to FIG. 1, the exit opening 18 is of substantially the same external diameter as that of the blower casing 19. As a result, this opening overlaps the peripheral edges of the blower 21 and a portion of the snow blown by the blower 21 will reenter the auger housing as shown in the arrows in FIG. 1. It should be noted that the problem arises in the area indicated by the letter A in FIG. 1 wherein the pressure side of the blower casing 19 registers with the exit opening 18.

A further problem with this conventional type of snow blower is also the rectangular configuration of the blower blades and the blower casing 19. As seen in FIG. 3, this results in a generally square cross-sectional area and snow can pack up as shown by the area S along the entire width of the blower casing. This occurs because there must be some clearance between the ends of the blower blades and the interior of the casing 19. However, as this snow accummulates and builds up, there is the possibility of the blower 21 striking it and actually stalling the operation of the snow blower 11.

It is, therefore, a principal object of this invention to provide an improved snow blower that will insure against loss of efficiency.

It is a yet further object of this invention to provide a snow blower wherein snow blown by the blower portion will not reenter the auger portion.

It is a yet further object of this invention to provide an improved configuration for the blower that tends to reduce the amount of snow that can accumulate within the blower casing.

SUMMARY OF THE INVENTION

A first feature of this invention is adapted to be embodied in a snow thrower comprised of an auger housing having an open front end and an auger that is rotatable about an axis that extends generally across the open front end for collecting snow and delivering the collected snow to a discharge area. A blower casing is disposed behind the auger housing and contains a blower that is rotatable about an axis that extends generally transverse to the axis of the auger. An exit opening extends beetween the auger housing and the blower casing for transferring of snow collected by the auger to be discharged from the blower casing. In accordance with a first feature of the invention, the exit opening is positioned and configured to prevent snow thrown by the blower from returning into the auger casing.

In accordnace with another feature of the invention, the blower casing is configured with a curved peripheral edge that is complementary in shape to curved tips of the blower.

BRIEF DESCRIPTION OF THE DRAWINGS

FIG. 6 is a cross-sectional view of this embodiment taken along a plane corresponding to that of FIG. 2 and on the same scale.

FIG. 7 is a side elevational view of the blower configuration.

FIG. 8 is a bottom plan view of the blower of this embodiment.

FIG. 9 is a cross-sectional view, in part similar to FIG. 3, showing how snow accumulation is not a problem with this particular type of contruction.

FIG. 10 is a side elevational view of a blower constructed in accordnace with a second embodiment of the invention.

FIG. 11 is a top plan view of the blower of this embodiment.

DETAILED DESCRIPTION OF THE PREFERRED EMBODIMENTS

Figure 1:
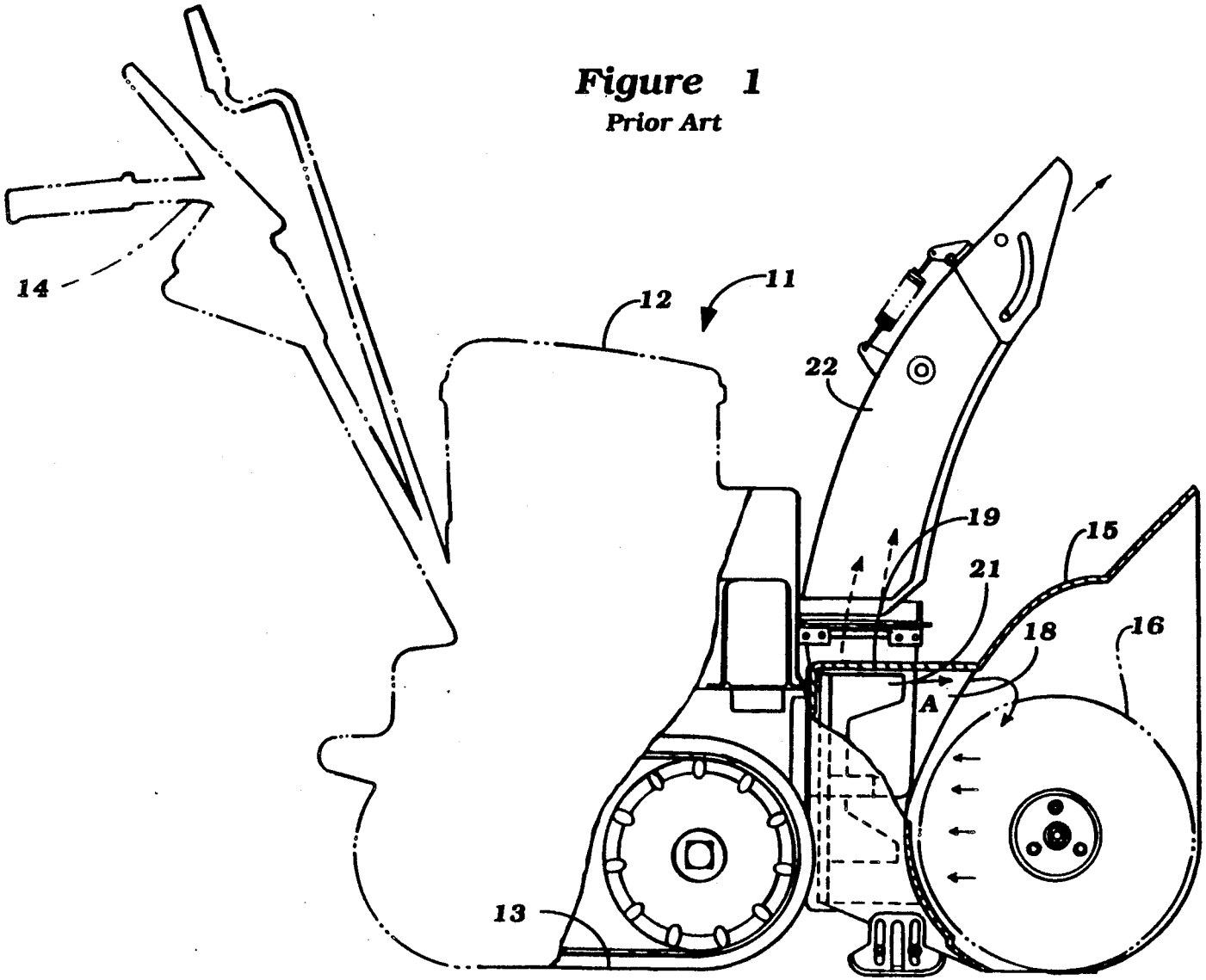
Figure 1 Prior Art
FIG. 1 is a side elevational view, with a portion broken away and other portions showns in phantom, of a snow blower constructed in accordance with the prior art.
Figure 2:
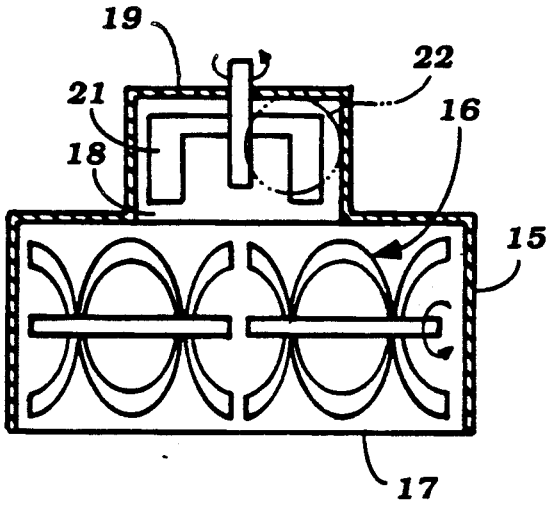
Figure 2 Prior Art
FIG. 2 is a horizontal cross-sectional view, on a reduced scale and in partially schematic fashion, through the blower casing and auger housing.
Figure 3:
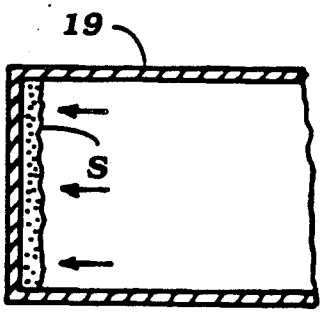
Figure 3 Prior Art
FIG. 3 is a cross-sectional view showing the peripheral edge of the blower casing.
Figure 4:
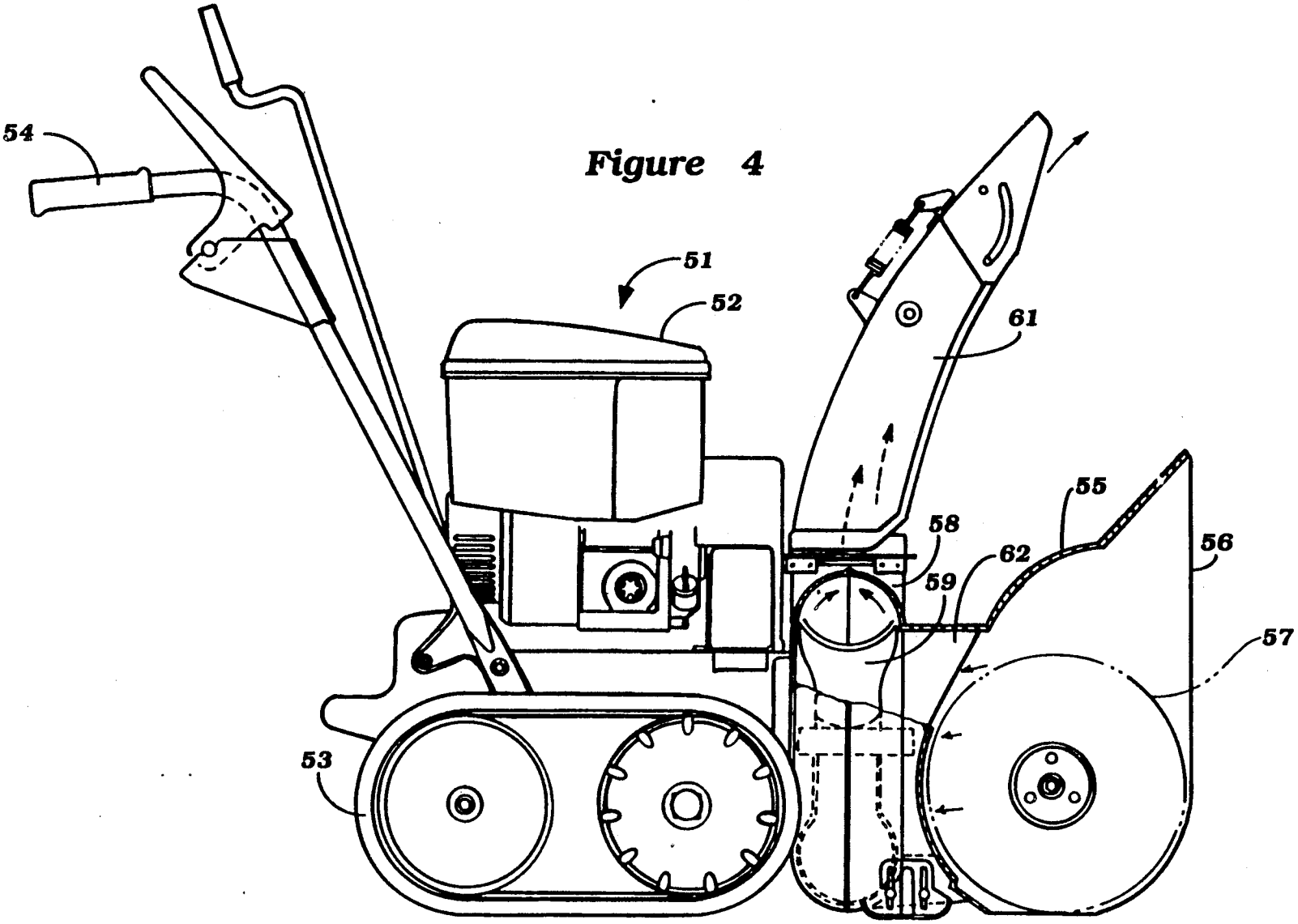
FIG. 4 is a side elevational view, in part similar to FIG. 1, showing a snow blower constructed in accordance with a first embodiment of the invention.
Figure 5:
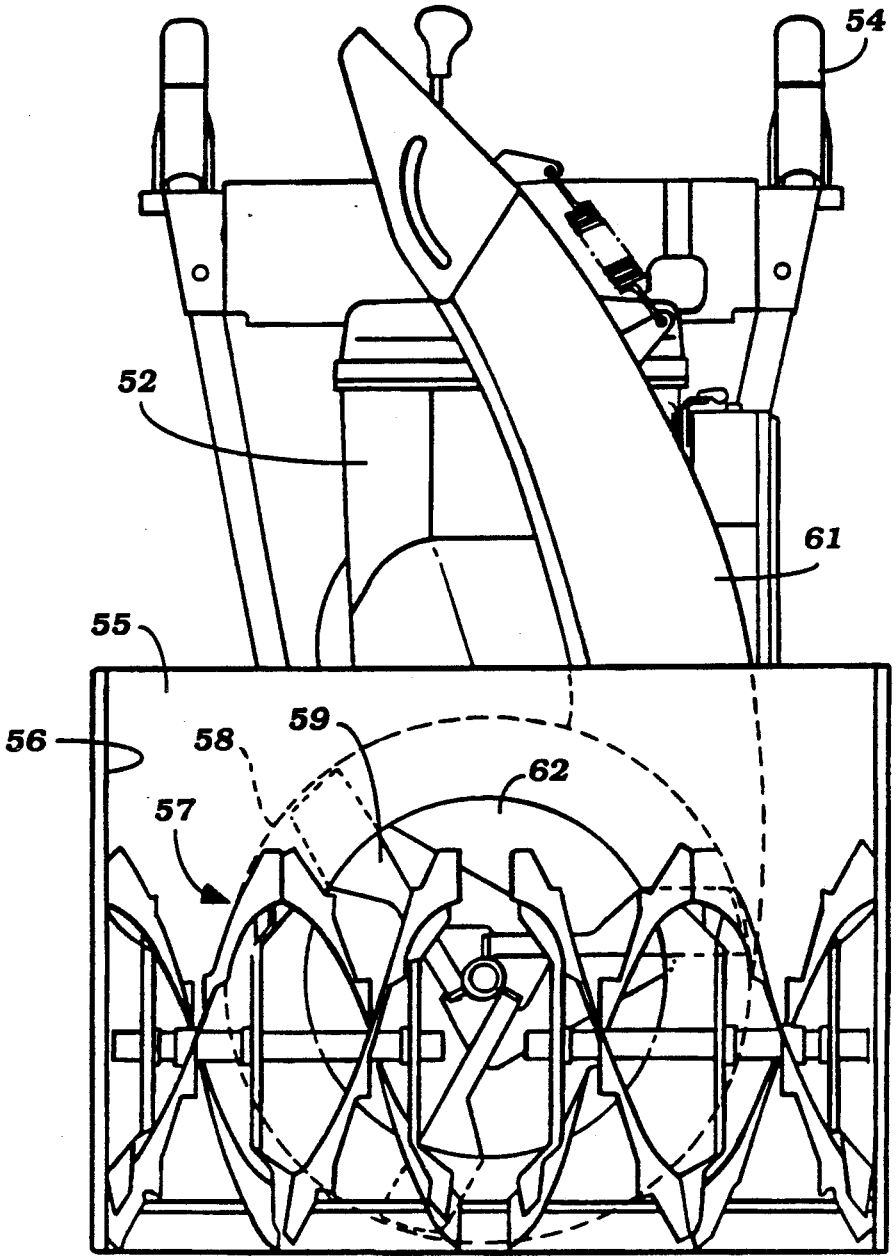
FIG. 5 is a front elevational view of this embodiment.

Referring first to FIG. 4, a snow blower constructed in accordance with an embodiment of the invention is identified generally by the reference numeral 51. The snow blower 51 includes an internal combustion engine 52 which propels the snow blower 51 by means of a drive belt 53. A handlebar assembly 54 is provided for controlling the snow blower 51 in a known manner. An auger housing 55 is positioned at the front of the snow blower 51 and has a forwardly facing opening 56 into which snow can be drawn. An auger 57 is rotatably journaled about a horizontally extending axis that extends transversely across the opening 56 for collecting snow and delivering it to a central discharge area.

A blower casing 58 is disposed rearwardly of the auger housing 55 and contains a blower 59, having a configuration as shown in FIGS. 7 and 8, for collecting the snow delivered by the auger 57 and discharging it through a discharge chute 61.

In accordance with the invention, an exit opening 62 which is substantially smaller in diameter than the blower 59 and which is positioned generally centrally of the blower 59 connects the discharge area of the housing 55 with the blower casing 58. As may be readily seen from FIG. 4, this configuration is such that snow collected by the auger and delivered to the blower casing 58 will not return through the opening 62. As a result, the efficiency is substantially increased.

As may be seen in FIGS. 7 and 8, the blower 59 has a plurality of generally radially extending spoon shaped blades 63 that are affixed to a supporting hub 64 which, in turn is affixed to a driving shaft in a suitable manner. There are provided reinforcing ribs 65 for strengthening the blower assembly.

As may be best seen in FIGS. 6 and 9, the blower casing 58 has its peripheral edge curved so as to provide an arcuate surface 65 that is complimentary to the tips of the blades 63. As a result, snow S, which tends to accumulate, will be conveyed to the central portion where it will be readily clipped off by the blades 63 as they rotate so that there will be no significant accumulation of snow that could clog the assembly.

FIGS. 10 and 11 show another configuration of blower assembly, indicated generally by the reference numeral 101 that can be utilized in a blower casing of the type shown in the previously described embodiment. In this embodiment, generally flat blades 102 are formed that have curved peripheral edges and which are affixed to a hub 103. Again, stiffening members 104 may be employed for strengthening the assembly.

It should be readily apparent from the foregoing description that the described embodiments of the invention are extremely useful in improving the efficiency of a snow blower and, at the same time, insuring that the amount of snow accumulation within the blower casing will be substantially from the prior art constructions. Although two embodiments of the invention have been illustrated and described, various changes and modifications may be made without departing from the spirit and scope of the invention, as defined by the appended claims.

I claim:

1. In a snow thrower comprised of an auger housing having side walls, a rear wall and an open front end, and auger rotatable within said auger housing about a horizontal axis extending generally across said open front end and between said side walls for collecting snow and delivering the collected snow to a discharge area, said rear wall being juxtaposed to said auger and curved upwardly from a lower edge adapted to contact the ground to a point above said auger axis about a center substantially coincidental with said blower axis, a blower casing disposed behind said auger housing and containing a blower rotatable about an axis generally transverse to the axis of said auger, said blower having impeller portions extending radially beyond said blower axis and an exit opening formed in part by said auger housing rear wall and extending uninterruptedly between said auger housing and said blower casing for transfer of snow collected by said auger to be discharged from said blower casing, said exit opening lying substantially inwardly of the outer periphery of said impeller in all angular positions thereof to prevent snow thrown by said blower impeller portion from returning to said auger housing.

2. In a snow throwers as set forth in claim 1 wherein the blower casiong is formed with an inner surface that is concave in planes containing the blower axis for minimizing snow accumulation therein and radially outwardly of the exit opening.

3.In a snow thrower as set forth in claim 2 wherein the blower impeller portions have a curvature at their peripheral edge complementary to that of the blower casing.

4. In a snow thrower as set forth in claim 3 wherein the blower impeller portions have a spoon shaped configuration.

5. A blower casing for a snow thrower comprising an outer casing containing the blower rotatable about an axis and having an inlet opening at one side thereof and a discharge opening at the peripheral edge thereof radially outwardly from said blower axis, said blower casing having a concave inner surface in planes containing the axis of said blower and around the circumference of said blower and radially outwardly of said inlet opening in all directions around the circumference for reducing the accumulation of snow therein.

6. In a blower casing as set forth in claim 5 wherein the blower has blades with a curvature at their peripheral edges complementary to that of the blower casing.

7. In a blower casing as set forth in claim 6 wherein the blower blades have a spoon configuration.

* * * * *